US006470593B1

(12) United States Patent
Seo

(10) Patent No.: US 6,470,593 B1
(45) Date of Patent: Oct. 29, 2002

(54) EJECTOR DEVICE FOR VACUUM DRYING

(75) Inventor: Kyu Young Seo, Anyang-Shi (KR)

(73) Assignee: Delta Medical Co., Ltd., Kyonggi-Do (KR)

( * ) Notice: Subject to any disclaimer, the term of this patent is extended or adjusted under 35 U.S.C. 154(b) by 0 days.

(21) Appl. No.: 09/985,027

(22) Filed: Nov. 1, 2001

(51) Int. Cl.[7] ..... F26B 13/30; F26B 5/04
(52) U.S. Cl. ..... 34/92; 34/403; 34/406
(58) Field of Search ..... 34/92, 287, 307, 34/308, 309, 351, 359, 361, 402, 403, 406, 541, 576, 582, 585, 605, 606, 641, 642; 239/318; 454/344; 137/893

(56) References Cited

U.S. PATENT DOCUMENTS 3,727,640 A * 4/1973 Sargeant ..... 137/604
5,113,655 A * 5/1992 Schumacher et al. ..... 60/408
5,151,250 A * 9/1992 Conrad ..... 422/2
5,626,291 A * 5/1997 Flinn ..... 239/310
5,638,609 A * 6/1997 Chndran et al. ..... 34/365
RE36,796 E * 8/2000 Sato et al. ..... 34/412
6,148,536 A * 11/2000 Iijima ..... 34/92
6,331,141 B1 * 12/2001 Chua ..... 454/344

FOREIGN PATENT DOCUMENTS

KR 1996-0011877 9/1996

* cited by examiner

*Primary Examiner*—Ira S. Lazarus
*Assistant Examiner*—K. B Rinehart
(74) *Attorney, Agent, or Firm*—Dickinson Wright PLLC

(57) ABSTRACT

The present invention relates to an ejector device for vacuum drying having at least first and second passages for connecting a first chamber with a second chamber, wherein the chambers are arranged substantially at right angles with respect to each other, and the ejector is adapted to vacuum dry the inside of the second chamber by means of high speed air flow toward the first chamber. The flow toward the first chamber preferably travels through the second passage from the first passage, on the side opposite the first chamber, to induce a negative pressure in the first passage. This way, the change in kinetic energy draws the stagnant air and steam existing in the second chamber into the inside of the first chamber.

12 Claims, 3 Drawing Sheets

EJECTOR DEVICE FOR VACUUM DRYING

FIELD OF THE INVENTION

The present invention relates to an ejector device for vacuum drying, and particularly to an ejector device to cause negative pressure by high-speed air jet for rapid drying of the environmental space under vacuum.

BACKGROUND OF THE INVENTION

There are many places requiring indoor drying operation. Particularly, however, the sterilizing devices used for sterilizing and disinfecting medical articles in hospitals or the like require drying process as an indispensable essential element, because in the case of failure in drying operation, the steam or moisture produced in the process of high pressure sterilization in the sterilizing device is entrained to sterilized articles, constituting a cause for propagation of other bacteria or infection when used as such.

Accordingly, conventional large-scale autoclaves are generally equipped with vacuum pumps for drying operation. The main reason for using vacuum pumps is to reduce the pressure dominant in the sterilizing chambers incorporated for sterilizing medical articles or the like. There are two reasons of generating a vacuum state by decreasing the pressure in a sterilizing chamber. The total vacuum process is composed of the pre-vacuum and post-vacuum processes. In the pre-vacuum process, the air or air layer in the chamber space is expelled out as the generated steam rises to penetrate and displace the air, as the air layer, a heat insulating layer, would otherwise inhibit the conductive heat transfer to thereby disfavor the sterilizing operation. In the subsequent post-vacuum process, the dry or superheated steam vapor originating from the moisture or water in the chamber can be discharged, as the temperature in the chamber is above the vaporization point or condensation point, which is low at this reduced prevailing pressure, so that a complete moisture removal or drying in the chamber can be realized. This is possible because the steam is continuously removed from the chamber by the vacuum pump.

In practice, however, most of vertical type autoclaves or the so-called top-table autoclaves are not provided with vacuum pumps, in contrast to the large scale autoclaves. The reason for this is that sterilizing devices become heavy for their size and the vacuum pumps should be further equipped with accessories like water supplying pipes and water draining pipes and moreover the pumps generate severe vibration and noise.

However, the top-table autoclaves have the advantage that they are more easily movable compared to the large-scale autoclave described above and can be put to use at any places where the electricity is available. Nevertheless, as the relevant vacuum pumps operate based on the suction of steam, the water is need. Thus, the installation of water supplying and draining pipes is essential, restricting free movement, so that the advantage of the top-table autoclaves mentioned above is cancelled out. Thus, sterilization of a top-table autoclave without a vacuum pump is conducted based on gravity mode, and thus there is caused the problem that drying should be performed during the drying process, with the door of the sterilizing chamber open.

The opening of the doors of sterilizing chambers during drying process is associated with the risk of bacteria or the like penetrating the inside of the sterilizing chambers to reduce the sterilization effect and furthermore to cause the users the inconvenience of opening and closing the door every individually.

SUMMARY OF THE INVENTION

Therefore, the object of the present invention is to provide an ejector device for vacuum drying, resolving the above-described drawbacks, which can generate a negative pressure by means of a high-speed air jet stream to evacuate the near-by space, so that the moisture of the wet articles positioned in that space may be rapidly vaporized under the surrounding reduced pressure to bring the articles to a complete dryness.

The above object is achieved according to an aspect of the invention by an ejector device for vacuum drying, comprising an ejector with at least a first and second passages for connecting the first and second chambers in mutual communication, the first and second chambers being arranged at the right angle to each other, wherein the ejector is adapted for vacuum-drying the inside of the second chamber by ejecting high-speed air toward the first chamber via the second passage from the first passage's side opposite to the first chamber to induce a negative pressure in the first passage due to the change in kinetic energy so as to draw the stagnant air and steam existing in the second chamber into the inside of the first chamber.

Preferably, the vacuum drying ejector comprises a body formed, at the one ends of the first and second passages, with the first and second connecting sections for water-tight connection with the first and second chambers, the first and second passages being perpendicular to each other, and an air jet nozzle detachably connected to said body through screwing at the first passage's end opposite to the first chamber, provided with the third passage for connection with an air pump, and provided with an air jet hole or channel to be in communication with the first and second passages, said air jet nozzle forming a gap between its front outer circumference and the wall of the first passage along the area beyond the position of the second passage.

Further, said air jet hole or channel is preferably formed tapered toward the front end of the air jet nozzle to result in the form of a cone frustum.

DETAILED DESCRIPTION OF THE INVENTION

A preferred embodiment of the invention will be descried in detail below by referring to the accompanying drawings.

Figure 1:
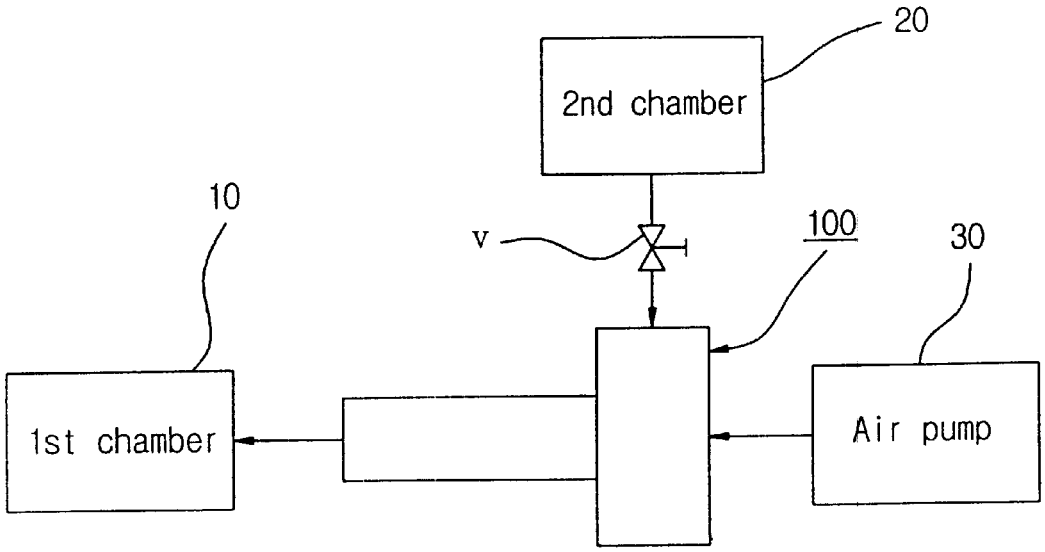
FIG. 1 shows roughly the disposition of the ejector device for vacuum drying according to the present invention.

FIG. 1 shows roughly the disposition of a vacuum drying ejector apparatus according to a preferred embodiment of the invention.

As shown in the drawing, the ejector device 100 according to the invention is disposed in communication with a first chamber 10 and second chamber 20, wherein these chambers are located perpendicular to each other. An air compressor 30 positioned opposite to the first chamber 10 supplies a high-speed air jet toward the first chamber 10 to produce a negative pressure in the ejector device 100 through the increase in kinetic energy or velocity head of air stream, so that the air, vapor and the like remaining in the second chamber 20 can be drawn in the inside of the first chamber 10, with the result that drying is favorably accomplished in the second chamber 20 under the vacuum atmosphere. In the evacuating operation by using the ejector 100, the first chamber 10 is left open to the atmosphere, while the second chamber 20 is kept in closed state. The construction of the ejector device 100 according to the invention is described in detail by referring to FIG. 2.

Figure 2:
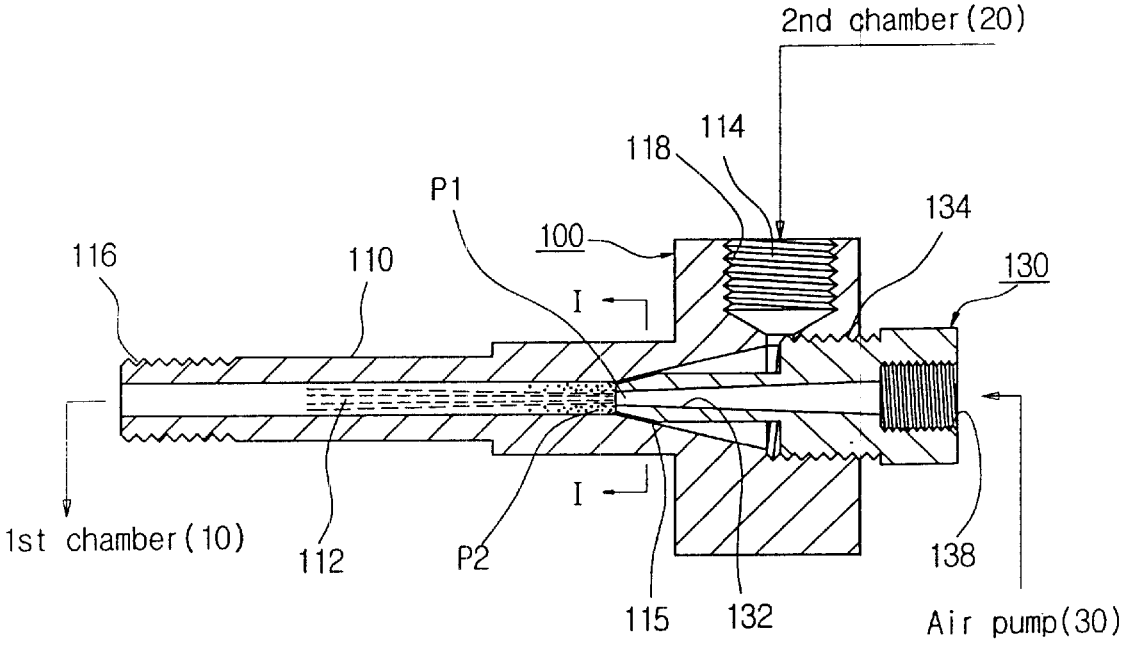
FIG. 2 shows the enlarged view of the ejector for vacuum drying singly taken out from FIG. 1.

FIG. 2 shows the enlarged cross section of the vacuum drying ejector shown in FIG. 1.

As shown in the drawing, the ejector 100 according to the invention comprises an ejector body 110 of metal to stand a severe condition like high pressure and an air nozzle 130.

Passages 112 and 114 are continuously formed substantially perpendicular to each other in the ejector body 110 to connect the first and second chambers 10 and 20. The first passage 112 extends longitudinally along and over the full length of the ejector body 110, while the second passage 114 positioned at one end of the ejector body 110 or on the side opposite to the first chamber 10 extends at the right angle to the first passage 112 to communicate with the latter. Accordingly, the first and second chambers 10 and 20 are in fluidic communication through the first and second passages 112 and 114. At the end openings of the first and second passages 112 and 114, there are provided a first and second screwed connections 116 and 118 for air-tight connection with the first and second chambers 10 and 20. To the first and second screwed connections 116 and 118, the connections (not shown) formed on the extended pipes at the first and second chambers 10 and 20 are connected air-tight, instead of directly joining to the first and second chambers 10 and 20, for the purpose of convenience.

The air jet nozzle 130 which is disposed detachably through thread 134 inside the first passage 112 on the opposite side of the first chamber 10 ejects the high-pressure air produced from the air pump 30 through the first passage 112 of the main body 110. As the air jet nozzle 130 is formed with a jet hole 132 throughout the full extension of nozzle 130 to be in communication with the first passage 112, the high-pressure air from the air pump 30 can be jetted into the first passage 112. Particularly, the air jet nozzle 130 is arranged in the main body 110 to connect the air jet hole 132 of the air jet nozzle 130 with the second passage 114, in such a manner that the air jet nozzle 130 is disposed in avoidance of blocking the second passage 114 and at the same time, the outer circumferential front surface of the air jet nozzle 130 is disposed at a gap width d from the inner circumferential wall of the first passage 112, wherein to form this gap, the front surface of the air jet nozzle 130 and the corresponding surface of the first passage 112 are preferably tapered 115. In forming the gap d from the circumferential wall surface of the first passage 112, the length of the air jet nozzle 130 is so chosen that the predetermined gap d may be automatically formed between the front area of the nozzle 130 and the corresponding front surface area of the first passage 112, when the air jet nozzle 130 is mounted in the ejector body 110 through screwed connection. The gap d is provided to form the state of communication among the air jet hole 132 of the air jet nozzle 130, and the first and second passages 112 and 114. The gap size can be freely controlled by adjusting the air jet nozzle 130 through the screwed section 34 wherein the gap d is preferably adjusted to be narrow enough so far as the friction is not so severe. Furthermore, as shown in the drawing, the air jet hole 132 of the air jet nozzle 130 is preferably constructed in the form of a cylinder tapering toward the front tip, so that the air stream from the air pump 30 may attain an increased jetting velocity for better or higher performance.

Preferably the air jet ejector 130 is mounted in the ejector body 110 so as to protrude from this ejector body, so that connection with the air pump 30 is facilitated in the subsequent assembling work. The projected part of the jet nozzle 130 is provided with the third screwed section 138 for connection with the air pump 30.

Thus, the air supplied from the air pump 30, when the latter goes into operation, is directed toward the first passage 112 through the air jet hole 132 of the air jet nozzle 130, wherein the air stream reaching the point P1 of least cross section attains a very high velocity and so low pressure before jetting from the air jet hole 132. The air at the point P2 just in front of the point P1 will be at lowest pressure, naturally a negative pressure under atmospheric pressure, capable of sucking the surrounding high-pressure fluid, particularly the air in the second chamber 20. Therefore, the air, vapor etc. remaining in the second chamber 20 are sucked, through the second passage 114 and the gap d, into the area near the position P1 in the first passage 112 where they are mingled with the operating air from the air jet nozzle 130 and then the air is drawn in the first chamber 10, with the result that the inside of the second chamber 20 is evacuated to be favorable for drying. The jetting velocity of the air through the air jet nozzle 130 can be controlled by changing the diameter of an jet hole 132 or the nozzle. The determination of the completion of evacuation in the second chamber 20 is carried out through a vacuum gauge (not shown) in the second chamber 20, wherein the completion of vacuum drying operation is conducted by interrupting the operation of the air pump 30 together with the closure of the valve V to the second chamber (see FIG. 1). The operation and interruption of air pumps as well as the opening and closing of the valves V in connection with vacuum drying operation in the second chambers can be automated by means of appropriate circuitry, which can be realized in various manners as the corresponding circuitry is well known in the art.

Figure 4:
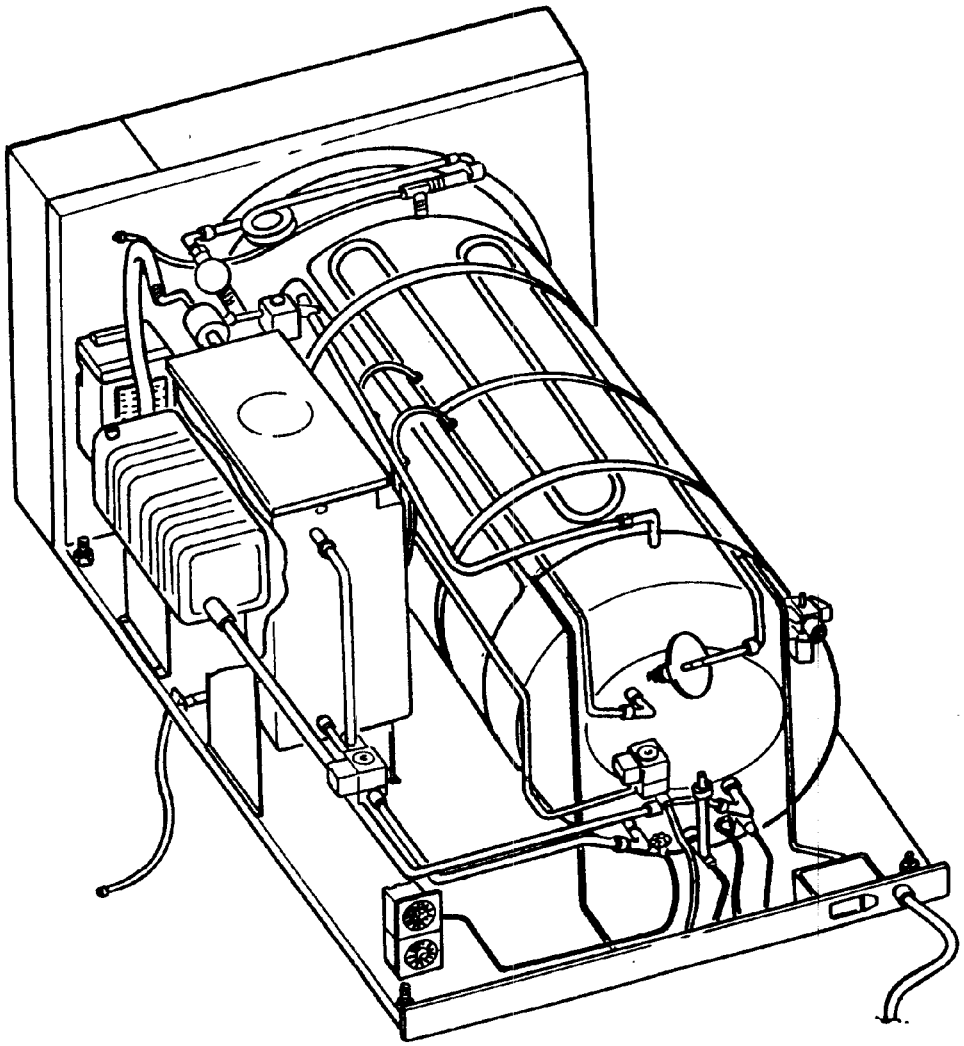
FIG. 4 shows the perspective view of the inside of an autoclave equipped with an air ejector device for vacuum drying according to the invention.

FIG. 4 shows the inside of a medical autoclave as provided with a vacuum drying ejector device according to the invention. The same reference symbols as in the foregoing for the same parts are used here to avoid repetition.

Referring briefly to a medical autoclave 1 to which the present invention is to be applied before describing an example of the present invention as applied to an autoclave, a medical autoclave 1 is used in a hospital or clinic to disinfect and sterilize a variety of medical articles including surgery tools and clothes through the process consisting of water supplying, sterilizing, evacuating and drying, as described further in the following.

(1) First, in the water supplying step, a solenoid valve 5 is opened, so that the water reserved in a storage tank 10 may flow through a water supplying pipe 6 into a chamber 20 enclosing an sterilizing room. The water flow into the chamber 20 is stopped by the closure of the solenoid valve 5 as controlled by a water-level sensor 9.

(2) The end of water supply is followed by the sterilizing step. The sterilizing step is conducted with the help of a heater 13 installed in the chamber 20 and continues until the temperature and pressure in the sterilizing chamber formed inside the chamber 20 reach preset values, wherein the cold air present initially in the sterilizing chamber and a part of heated steam below the preset temperature are discharged into the upper space of the storage tank 10 through an air exhauster 4 via a venting pipe 14. When the temperature and pressure inside the sterilizing chamber reach preset values through the continued heating of the heater 13, the air exhauster 4 is closed and thus the medical supplies placed in the sterilizing chamber are disinfected and sterilized under now-prevailing high temperature and pressure.

(3) When the sterilizing work is completed, an exhausting step is conducted, wherein the superheated high pressure steam in the sterilizing chamber is discharged. With the solenoid valve 5 and air exhauster 4 opened, the chamber steam and air are rapidly returned through the pipes 6 and 14 to the storage tank 10, the upper space of which is connected to the outside atmosphere. Natural exhaust from the sterilizing chamber takes place until the temperature in the chamber drops to about 100° C. corresponding to the atmospheric pressure.

(4) Drying step follows the exhausting step. This drying step is conducted in order that any possible unvaporized water, any steam left-out even after the exhausting step and the moisture retained in the articles intended for disinfection may all be dehydrated or dried. The drying operation is carried out by the ejector device 100 according to the invention. In particular, to the ejector device 100, the storage tank 10 corresponding to the first chamber in FIGS. 1 and 2 is directly and the chamber 20 formed with the sterilizing chamber, corresponding to the second chamber in FIGS. 1 and 2, is through the valve V connected. An air pump or compressor 30 on the side opposite to the storage tank 10 is connected to the ejector device 100 through a pipe 32.

Figure 3:
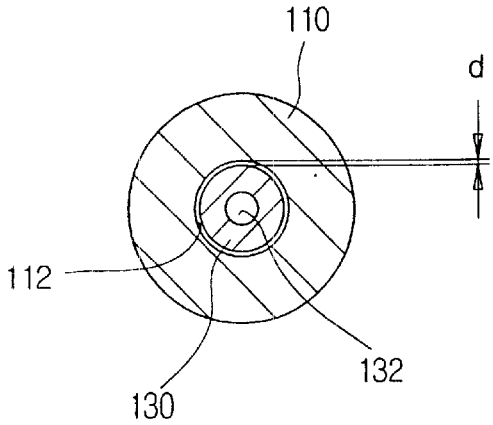
FIG. 3 shows the enlarged cross section along the line I—I in FIG. 2.

Accordingly, as described with regard to the embodiment depicted in FIGS. 1 to 3, the air generated in the air compressor 30, brought into operation, is ejected at a high speed toward the water storage tank 10 through the air jet nozzle (see FIG. 2) equipped in the ejector device 100 to produce a negative pressure, whereby the stagnant air together with the moisture adhered to the medical supplies during the prior sterilizing step in the sterilizing chamber of the chamber 20 is drawn through the valve V to the operating jet air to be flowed into the tank 10. As the result, drying is favorably conducted under a vacuum atmosphere in the sterilizing room of the chamber 20. This drying operation continues for a predetermined period long enough to bring the wet medical articles to the complete drying. The valve V is so designed as to automatically close with the interruption of the air pump 30. In other words, the valve is automatically turned on and off depending on the operation and interruption of the air pump 30. The principal drying in the sterilizing room of the chamber 20 is initiated with the interruption of the air pump 30 and is completed after a preset time, when the door is opened and the dry disinfected medical articles are withdrawn.

Although the ejector devices according to the invention as used for evacuating sterilizing chambers were described, the ejector devices according to the invention may be operated for supplying the water in the same system, wherein causing the negative pressure in the sterilizing room of the chamber 20 can suck the water from the storage tank 10 into the sterilizing room through the opened solenoid valve 5 and water supplying pipe 6.

Although the embodiment as represented in FIG. 4, in which the ejector according to the invention was applied to a sterilizing autoclave, was described, the present invention can be applied to the processes of enriching, distillation, deodorization, crystallization, gas exhausting, impregnation, mixing, cooling, transferring and the like.

As described above, the main advantage of the invention lies in that the invention has substantially the same performance as the conventional art in spite of using simple, compact, noiseless and low-cost ejector-air compressor drying apparatuses in the place of complicated, noisy, high-cost and water pipes necessitating vacuum pump type apparatuses. The ejector according to the invention can be further applied, beside drying, to other processes of enriching, distillation, deodorization, crystallization, gas exhausting, impregnation, mixing, cooling, transferring and the like.

What is claimed is:

1. An ejector device for vacuum drying, comprising:

a first chamber with a first passage extending in a first direction, and a second chamber with a second passage extending in a second direction, wherein said first and second passages are adapted to communicate with each other;

an adjustable nozzle adapted to communicate with said first and second passages, and to control flow from said second passage to said first passage, and to eject high-speed air toward said first chamber through said first chamber in said first direction, wherein negative pressure can be formed in said first passage, and wherein stagnant air and steam existing in said second chamber can be drawn from said second chamber and into said first chamber, via said first and second passages, wherein the inside of said second chamber can be vacuum-dried thereby.

2. The device of claim 1, wherein said first and second directions are substantially perpendicular to each other.

3. The device of claim 1, wherein said first and second chambers are connected to a body having said first and second passages extended therein, and said nozzle is adjustably connected to said body and has a hole or channel therein for ejecting air toward said first chamber.

4. The device of claim 3, wherein a gap is formed between said nozzle's outer surface and an internal surface of said first passage through which said stagnant air and steam can pass from said second passage into said first passage.

5. The device of claim 4, wherein said gap is capable of being adjusted by adjusting the position of said nozzle relative to said internal surface.

6. The device of claim 5, wherein said nozzle and body have threaded sections which allow said nozzle to be adjusted relative to said internal surface.

7. The device of claim 6, wherein said nozzle's outer surface has a substantial frusto-conical external shape, and said internal surface has a substantial frusto-conical interior shape, wherein said gap is formed therebetween.

8. The device of claim 7, wherein an air pump is attached to said body and a third passage is formed in said nozzle communicating with said hole or channel and said air pump.

9. The device of claim 1, wherein said nozzle is located downstream from said second passage such that said nozzle can control the flow of said stagnant air and steam drawn from said second chamber and into said first chamber.

10. An ejector device for vacuum drying, comprising:

an ejector with at least first and second passages for connecting first and second chambers in mutual communication, wherein the ejector is adapted for vacuum-drying the inside of the second chamber by ejecting high-speed air toward the first chamber from the first passage's side opposite the first chamber to induce a negative pressure in the first passage due to a change in kinetic energy so as to draw via the second chamber stagnant air and steam existing in the second chamber into the inside of the first chamber; and wherein an air ejector nozzle is adjustably connected to said ejector at the first passage's end opposite the first chamber, and provided with a third passage for connection with an air pump, and an air hole or channel to be in communication with the first and second passages, said air jet nozzle forming a gap between the nozzle's front outer surface and a wall of the first passage beyond the position of the second passage.

11. The ejector device for vacuum drying according to claim 10, wherein said ejector comprises a body formed, at one end of the first and second passages, with first and second connecting sections for water-tight connection with the first and second chambers, the first and second passages being substantially perpendicular to each other.

12. The ejector device for vacuum drying according to claim 11 wherein said air jet hole or channel is formed tapered toward a front end of the air jet nozzle to result in the form of a cone frustum.

* * * * *